US012624851B2

(12) United States Patent
Viggiani-Nunes

(10) Patent No.: US 12,624,851 B2
(45) Date of Patent: May 12, 2026

(54) ULTRAVIOLET AIR PURIFYING SYSTEM AND METHOD

(71) Applicant: Viggiani and Associates, Rochester, NY (US)

(72) Inventor: Michael A Viggiani-Nunes, Rochester, NY (US)

(73) Assignee: VIGGIANI AND ASSOCIATES, Clarence, NY (US)

( * ) Notice: Subject to any disclaimer, the term of this patent is extended or adjusted under 35 U.S.C. 154(b) by 396 days.

(21) Appl. No.: 18/232,423

(22) Filed: Aug. 10, 2023

(65) Prior Publication Data

US 2024/0053034 A1 Feb. 15, 2024

Related U.S. Application Data

(60) Provisional application No. 63/397,678, filed on Aug. 12, 2022.

(51) Int. Cl.

| | |
|---|---|
| ***F24F 8/22*** | (2021.01) |
| ***F24F 11/523*** | (2018.01) |
| ***F24F 11/56*** | (2018.01) |
| ***F24F 11/63*** | (2018.01) |
| ***F24F 110/10*** | (2018.01) |
| ***F24F 110/30*** | (2018.01) |
| ***F24F 110/70*** | (2018.01) |

(52) U.S. Cl.

CPC ..... *F24F 8/22* (2021.01); *F24F 11/523* (2018.01); *F24F 11/56* (2018.01); *F24F 11/63* (2018.01); *F24F 2110/10* (2018.01); *F24F 2110/30* (2018.01); *F24F 2110/70* (2018.01)

(58) Field of Classification Search

CPC .. F24F 8/22; F24F 11/523; F24F 11/63; F24F 11/56

See application file for complete search history.

(56) References Cited

U.S. PATENT DOCUMENTS

| | | | | |
|---|---|---|---|---|
| 11,441,797 | B1 * | 9/2022 | Meacham | F24F 11/64 |
| 2011/0185302 | A1 * | 7/2011 | Kalapodas | G06F 3/0481 715/771 |
| 2022/0170651 | A1 * | 6/2022 | Martensen | F24F 8/22 |

FOREIGN PATENT DOCUMENTS

| | | | | |
|---|---|---|---|---|
| CA | 2861413 C | * | 1/2019 | F24F 11/65 |

* cited by examiner

*Primary Examiner* — Sean E Conley
(74) *Attorney, Agent, or Firm* — PATENT PORTFOLIO BUILDERS PLLC

(57) ABSTRACT

A method includes receiving, by at least one processor, realtime data associated with airflow in a heating, ventilation, and air conditioning (HVAC) system from at least one sensor device, comparing, by the at least one processor, the realtime data from the at least one sensor device with a particular value for each sensor, operating, by the at least one processor, at least one ultraviolet C (UV-C) lamp device in the HVAC system, purifying air in the HVAC system using the at least one UV-C lamp device while confirming, by the at least one processor, that the realtime data from the at least one sensor device is within a particular threshold of each particular value for each sensor, and supplying clean, disinfected air to the airflow in the HVAC system.

10 Claims, 8 Drawing Sheets

ULTRAVIOLET AIR PURIFYING SYSTEM AND METHOD

CROSS REFERENCE TO RELATED APPLICATIONS

This application is related to and claims priority under 35 U.S.C. § 119(e) to U.S. Patent Application No. 63/397,678, filed Aug. 12, 2022, entitled "Ultraviolet Air Purifying System and Method," the entire contents of which are incorporated herein by reference.

BACKGROUND

Viruses and bacteria can be easily spread in certain environments such as commercial office buildings, schools, hospitals, retail stores, supermarkets, or industrial facilities such as warehouses or factories. Viruses and bacteria can be spread through the air in the office or other facilities which can cause the spread of airborne diseases. Closed occupied spaces such as offices may have poor and outdated air ventilation systems.

Conventional heating, ventilation, and air conditioning (HVAC) systems may focus on air changes and filtration to clean the air. This simply does not provide a sufficient solution.

It is with these issues in mind, among others, that various aspects of the disclosure were conceived.

SUMMARY

According to one aspect, an ultraviolet air purifying system and method is provided for disinfecting and purifying air in buildings such as commercial office buildings, schools, hospitals, retail stores, supermarkets, or industrial facilities such as warehouses or factories, among other locations.

In one example, a method may include receiving, by at least one processor, realtime data associated with airflow in a heating, ventilation, and air conditioning (HVAC) system from at least one sensor device, comparing, by the at least one processor, the realtime data from the at least one sensor device with a particular value for each sensor, operating, by the at least one processor, at least one ultraviolet C (UV-C) lamp device in the HVAC system, purifying air in the HVAC system using the at least one UV-C lamp device while confirming, by the at least one processor, that the realtime data from the at least one sensor device is within a particular threshold of each particular value for each sensor, and supplying clean, disinfected air to the airflow in the HVAC system.

In another example, a system may include at least one sensor device and at least one processor to receive realtime data associated with airflow in a heating, ventilation, and air conditioning (HVAC) system from the at least one sensor device, compare the realtime data from the at least one sensor device with a particular value for each sensor, operate at least one UV-C lamp device in the HVAC system, purify air in the HVAC system using the at least one UV-C lamp device while confirming that the realtime data from the at least one sensor device is within a particular threshold of each particular value for each sensor, and supply clean, disinfected air to the airflow in the HVAC system.

In another example, a non-transitory computer-readable storage medium may have instructions stored thereon that, when executed by at least one computing device cause the at least one computing device to perform operations, the operations including receiving realtime data associated with airflow in a heating, ventilation, and air conditioning (HVAC) system from at least one sensor device, comparing the realtime data from the at least one sensor device with a particular value for each sensor, operating at least one UV-C lamp device in the HVAC system, purifying air in the HVAC system using the at least one UV-C lamp device while confirming that the realtime data from the at least one sensor device is within a particular threshold of each particular value for each sensor, and supplying clean, disinfected air to the airflow in the HVAC system.

These and other aspects, features, and benefits of the present disclosure will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE DRAWINGS

The accompanying drawings illustrate embodiments and/or aspects of the disclosure and, together with the written description, serve to explain the principles of the disclosure. Wherever possible, the same reference numbers are used throughout the drawings to refer to the same or like elements of an embodiment, and wherein.

DETAILED DESCRIPTION

Figure 1:
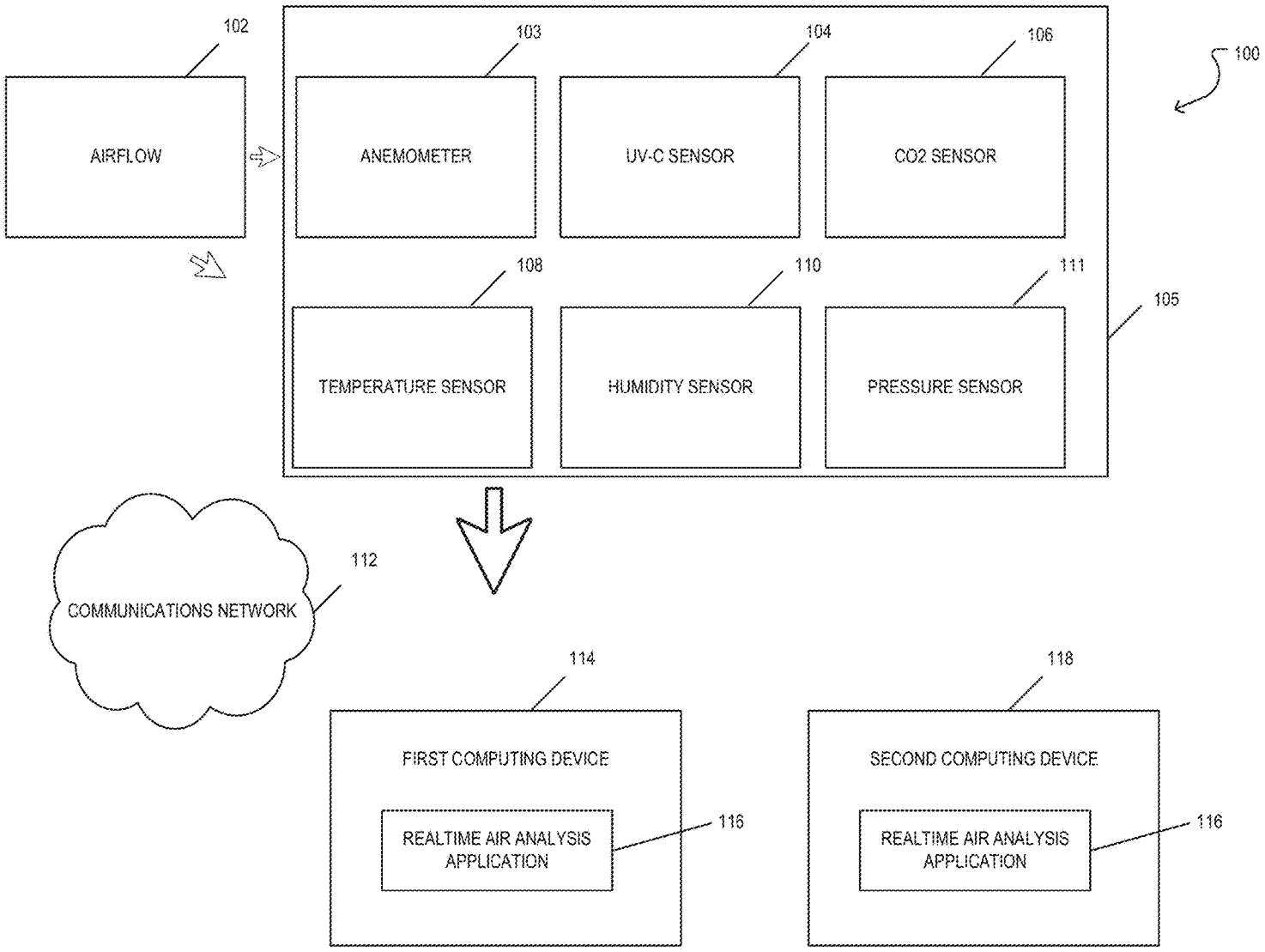
FIG. 1 is a block diagram of an ultraviolet air purifying system according to an example of the instant disclosure.

Aspects of an ultraviolet air purifying system and method for supplying clean, disinfected air to airflow in an HVAC system includes at least one sensor device to provide realtime information associated with airflow in an HVAC system, determining realtime information associated with the HVAC system based on the data associated with airflow from the at least one sensor device using at least one computing device that has a realtime air analysis application, and monitoring values provided by the at least one sensor device to confirm that the ultraviolet air purifying system is operating correctly. The at least one computing device can send messages and/or alerts to other computing devices such as client computing devices to allow users to take action to correct any issues with the ultraviolet air purifying system. The HVAC system may include a framework assembly including metal conduit, hangers, strut channels, and sub-assemblies. In addition, the ultraviolet air purifying system may include one or more ultraviolet C (UV-C) lamps having bracket assembly connections, a driver or electronic ballast, an enclosure, at least one air flow sensor, at least one modular probe for carbon dioxide ($CO_2$), humidity, temperature, and ambient pressure, at least one UV-C light sensor, and at least one computing device such as a programmable logic controller (PLC).

The ultraviolet air purifying system utilizes the one or more UV-C lamps to eradicate pathogens and biological agents in the air stream by timed exposure to UV-C at 254 nanometers of ultraviolet light. This destroys the pathogens and agents at a DNA level. The system further provides a direct control system verification of the process and can feed information and data back to a building management system (BMS) that can validate a status and condition of a functionality of the system.

The ultraviolet air purifying system may be an ETL approved system and incorporated into a building management system (BMS) and/or building automation system (BAS) such as a computer-based network system that monitors, regulates, and manages equipment and systems in buildings such as electrical lighting, HVAC, access control, security systems, and other BAS systems. In one example, BAS may refer to both the building automation system as well as the building management system, e.g., the BMS. BAS is a tool that allows building operations personnel to provide more effective and efficient control over building systems. As a result, BAS can provide improved occupant comfort, increased security, control over energy usage, reduced operating and maintenance costs, effective operation of building automation, remote access, control, and operation as well as data collection. BAS systems may include one or more sensors, controllers, communication networks, at least one computing device, and at least one application executed by the at least one computing device.

UV-C radiation can be used to disinfect air, water, and nonporous surfaces. UV-C radiation can be used to reduce the spread of bacteria. In addition, UV-C radiation can be used to destroy viruses including coronaviruses and flu viruses, among others. Unfortunately, UV-C radiation also can be harmful to people and may pose potential health and safety risks depending on the UV-C wavelength, dose, and duration of radiation exposure. The system provides monitored integral safety devices to prevent such exposure to UV-C radiation.

As an example, the system may include at least one sensor device and at least one processor of a computing device to receive realtime data associated with airflow in a heating, ventilation, and air conditioning (HVAC) system from the at least one sensor device, compare the realtime data from the at least one sensor device with a particular value for each sensor, operate at least one UV-C lamp device in the HVAC system, purify air in the HVAC system using the at least one UV-C lamp device while confirming that the realtime data from the at least one sensor device is within a particular threshold of each particular value for each sensor, and supply clean, disinfected air to the airflow in the HVAC system.

FIG. 1 illustrates a block diagram of an ultraviolet air purifying system 100 according to an example embodiment. The ultraviolet air purifying system 100 may include a plurality of sensor devices 105 that receive airflow 102 including at least one anemometer 103, at least one UV-C sensor 104, at least one $CO_2$ sensor 106, at least one temperature sensor 108, at least one humidity sensor 110, and at least one pressure sensor 111 that communicate via communications network 112 and provide information and data to at least one first computing device 114 having a realtime air analysis application 116. There also may be one or more safety sensors that can shut down the ultraviolet air purifying system 100 for safety reasons and/or other reasons.

The first computing device 114 may be a server computing device for the ultraviolet air purifying system 100. There also may be at least one second computing device 118 having the realtime air analysis application 116. The second computing device 118 may be a client computing device for the ultraviolet air purifying system 100.

The at least one first computing device 114 is configured to receive data from and/or transmit data related to the airflow 102 to the at least one anemometer 103, the at least one UV-C sensor 104, the at least one $CO_2$ sensor, the at least one temperature sensor 108, the at least one humidity sensor 110, and the at least one pressure sensor 111 through the communications network 112. Although the at least one first computing device 114 is shown as a single computing device, it is contemplated that the at least one first computing device 114 may include multiple computing devices. The first computing device 114 may receive the sensor inputs and values and can provide realtime data and information to the user that indicates the realtime information associated with the sensors.

The plurality of sensors 105 may include a safety sensor such as an on/off switch. When a door to the HVAC system is opened, the safety sensor can cut the power to the HVAC system by sending a signal to the at least one first computing device 114. The UV-C sensor 104 may measure intensity of UV-C light in nanometers (nm). The UV-C sensor 104 measures the intensity of ultraviolet (UV-C) radiation, which should be approximately 254 nm. The UV-C sensor 104 is a realtime sensor that determines a current value of the intensity and provides the value to the at least one first computing device 114. As noted above, it is to be 254 nm. Ultraviolet disinfection technology uses UV light to target and disable disease causing microorganisms (e.g., pathogens). In particular, it has been discovered that light around 254 nm is the most effective. If the value is determined to be outside of a particular threshold, the at least one first computing device 114 can send an alert or message to the at least one second computing device 118.

Airspeed through the HVAC system can be measured using one or more anemometers 103 or air velocity probes. If there is no airflow detected, the UV-C lamps can be shut off or shut down. The air velocity probe 103 may be the EE671 miniature air flow transmitter associated with HVAC applications or another air velocity probe. The EE671 air flow transmitter is robust and insensitive to contamination and can connect with the at least one first computing device 114 using a fixed cable or an M12 connector. Alignment strips associated with the probe may allow correct positioning in the airflow 102. If the airspeed value is determined to be outside of a particular threshold, the at least one first computing device 114 can send an alert or message to the at least one second computing device 118. In addition, the at least one first computing device 114 can disable or turn off UV-C lamps based on the airspeed.

Additionally, there may be a four-in-one $CO_2$ sensor that can determine $CO_2$ values, humidity values, temperature values, and pressure values. The four-in-one $CO_2$ sensor may include the $CO_2$ sensor 106, the temperature sensor 108, the humidity sensor 110, and the pressure sensor 111, among others. As an example, the four-in-one sensor may be the EE872. As an example, the four-in-one $CO_2$ sensor can measure $CO_2$ concentration up to 5% (50,000 ppm). Active pressure and temperature compensation with on-board sensors may allow for accurate $CO_2$ measurement accuracy that is independent of altitude or environmental conditions. As a result, $CO_2$ measured data can be available in analog voltage or current outputs. Temperature can be measured as a value in Fahrenheit or Celsius and may be provided to the at least one first computing device 114 as a value. Humidity can be measured as relative humidity (rH) and can be reported to the at least one first computing device as a value. Pressure can be measured as ambient pressure (p) and can be reported to the at least one first computing device 114 as a value. In addition, if the value of the $CO_2$, humidity, temperature, or pressure is determined to be outside of a particular threshold, the at least one first computing device 114 can send an alert or message to the at least one second computing device 118.

AC current can be measured in amps and can be reported to the at least one first computing device 114 as a value. A current switch can be used to monitor the current level. Current sensors, also commonly referred to as current transformers or CTs, are devices that measure the current running through a wire by using the magnetic field to detect the current and generate a proportional output. They are used with both AC and DC current. Current sensors allow the system 100 to be able to measure current passively, without interrupting the circuit in any way. They are placed around the conductor including current to measure.

The communications network 112 can be the Internet, an intranet, or another wired or wireless communication network. For example, the communications network 112 may include a Mobile Communications (GSM) network, a code division multiple access (CDMA) network, 3rd Generation Partnership Project (GPP) network, an Internet Protocol (IP) network, a wireless application protocol (WAP) network, a WiFi network, a Bluetooth network, a satellite communications network, or an IEEE 802.11 standards network, as well as various communications thereof. Other conventional and/or later developed wired and wireless networks may also be used.

The at least one first computing device 114 includes at least one processor to process data and memory to store data. The at least one first computing device 114 may be a programmable logic controller (PLC) or another type of computing device. The processor processes communications, builds communications, retrieves data from memory, and stores data to memory. The processor and the memory are hardware. The memory may include volatile and/or non-volatile memory, e.g., a computer-readable storage medium such as a cache, random access memory (RAM), read only memory (ROM), flash memory, or other memory to store data and/or computer-readable executable instructions such as a portion or component of the realtime air analysis application 116. In addition, the at least one first computing device 114 further includes at least one communications interface to transmit and receive communications, messages, and/or signals.

As an example, the at least one first computing device 114 may be a PLC such as the EXLW from Homer Automation Group having a built-in logic engine, an operator interface, networking, and input/output features. The at least one first computing device 114 may have a display device with a touchscreen, a USB On-the-Go (mini-B) port to receive the realtime air analysis application 116, a USB 2.0 host post to exchange files, at least one Ethernet port, and at least one Controller Area Network (CAN) port, as well as a microSD slot for a microSD card to store data and information associated with the ultraviolet air purifying system 100.

As an example, the at least one first computing device 114 may receive information from connected sensors 105 and input devices, process the data and information from the sensors and input devices, and trigger one or more outputs based on parameters provided by the realtime air analysis application 116. Depending on the inputs and outputs, the at least one first computing device 114 can monitor and store runtime data such as machine productivity or operating temperature, automatically start and stop processes, generate alarms if a machine malfunctions, and other functions. In one example, the at least one first computing device 114 can store and process program data and receive input and provide output to analog and digital devices. Input devices can include the plurality of sensors, switches, and meters and output devices may include relays, lights, valves, and drives, among others. The at least one first computing device 114 can connect with other systems such as a supervisory control and data acquisition (SCADA) system that can monitor multiple connected devices. The at least one first computing device 114 also provides a human machine interface such as a graphical user interface (GUI). The GUI can provide information to a user in realtime.

As an example, the realtime air analysis application 116 can utilize ladder logic that mimics circuit diagrams with "rungs" of logic that read left to right. Each rung can represent a specific action that can be controlled by the at least one first computing device 114 starting with an input or series of inputs (contacts) that result in an output (coil).

The at least one second computing device 118 can be a laptop computer, a smartphone, a personal digital assistant, a tablet computer, a standard personal computer, a programmable logic controller (PLC), or another processing device. The at least one second computing device 118 may include a display, such as a computer monitor, for displaying data and/or graphical user interfaces. The at least one second computing device 118 may also include a Global Positioning System (GPS) hardware device for determining a particular location of the at least one second computing device 118, an input device, such as a camera, a keyboard or a pointing device (e.g., a mouse, trackball, pen, or touch screen) to enter data into or interact with graphical and/or other types of user interfaces. In an exemplary embodiment, the display and the input device may be incorporated together as a touch screen of the smartphone or tablet computer.

The at least one second computing device 118 may display on the display a graphical user interface (or GUI). The graphical user interface may be provided by the realtime air analysis application 116. The graphical user interface enables a user of the at least one second computing device 118 to interact with the realtime air analysis application 116. As an example, each user of the second computing device 118 may view information and data associated with the ultraviolet air purifying system 100.

The realtime air analysis application 116 may be a component of an application and/or service executable by the at least one first computing device 114 and the at least one second computing device 118. For example, the realtime air analysis application 116 may be a single unit of deployable executable code or a plurality of units of deployable executable code. According to one aspect, the realtime air analysis application 116 may include one component that may be a web application, a native application, and/or a mobile application (e.g., an app) downloaded from a digital distribution application platform that allows users to browse and download applications developed with software development kits (SDKs) including the App Store and GOOGLE PLAY®, among others.

The ultraviolet air purifying system 100 may also include a relational database management system (RDBMS), a time-series database system, a blob storage system, or another type of database management system such as a NoSQL database system that stores and communicates data from at least one database. As an example, the at least one database may store information associated with the ultraviolet air purifying system 100 including the realtime information and data provided by each of the plurality of sensors 105.

Figure 2:
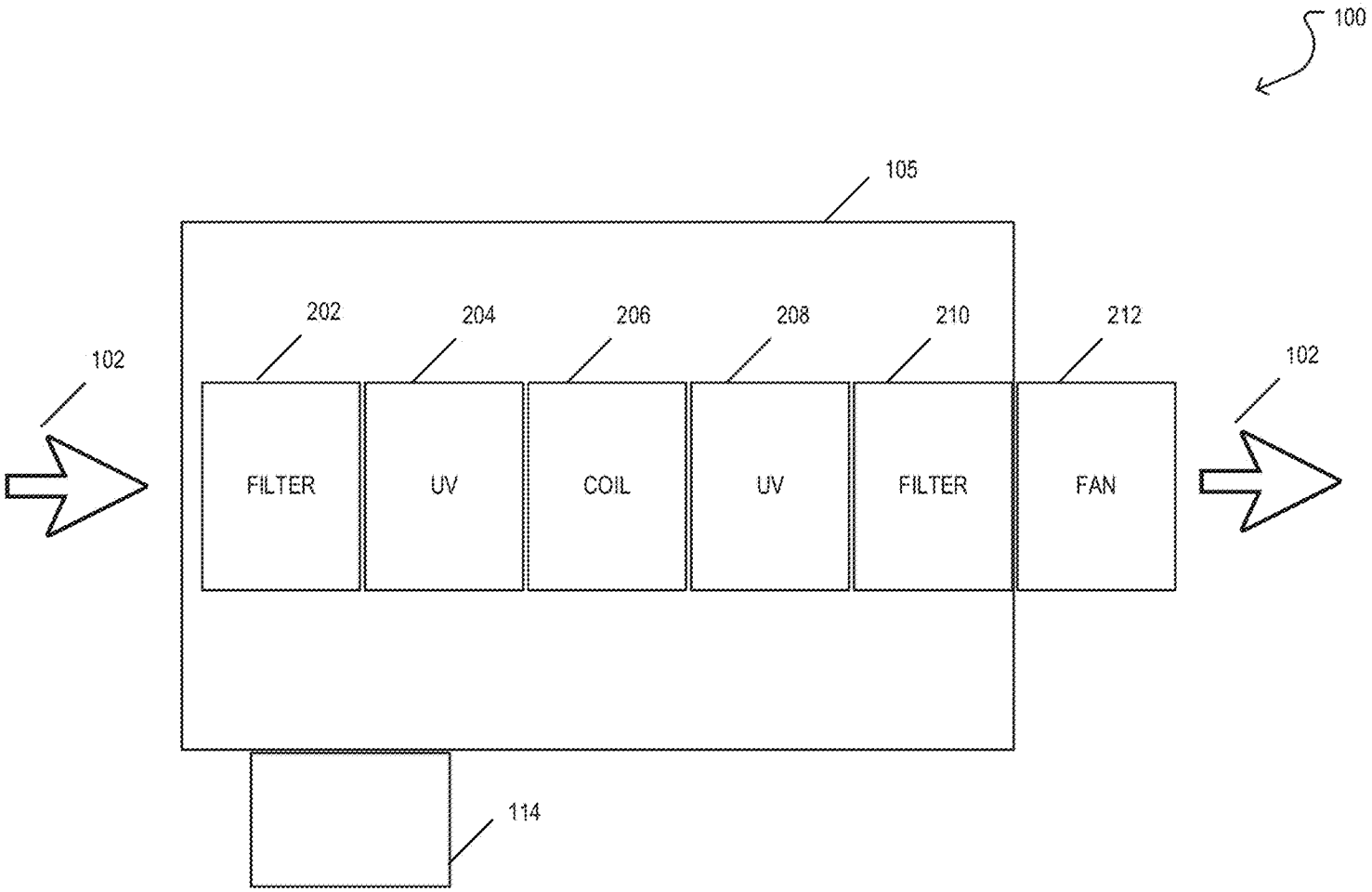
FIG. 2 is another block diagram of the ultraviolet air purifying system according to an example of the instant disclosure.

FIG. 2 is another block diagram of the ultraviolet air purifying system 100 according to an example of the instant disclosure. As shown in FIG. 2, the airflow 102 in the ultraviolet air purifying system 100 passes through at least one first filter 202 and then passes through at least one first UV device or lamp 204. Next, the airflow 102 passes through at least one coil 206 such as one or more heating coils and one or more cooling coils and through at least one second UV device or lamp 208. The airflow 102 passes through at least one second filter 210 and then is provided to at least one fan 212 to be sent to a particular space in a building such as a room or a subset of the building.

The plurality of sensors 105 shown in FIG. 1 may be located in the airflow 102 including in or near the at least one first filter 202, the at least one first UV device or lamp 204, the at least one coil 206, the at least one second UV device or lamp 208, the at least one second filter 210, and the at least one fan 212, among other locations.

Figure 3:
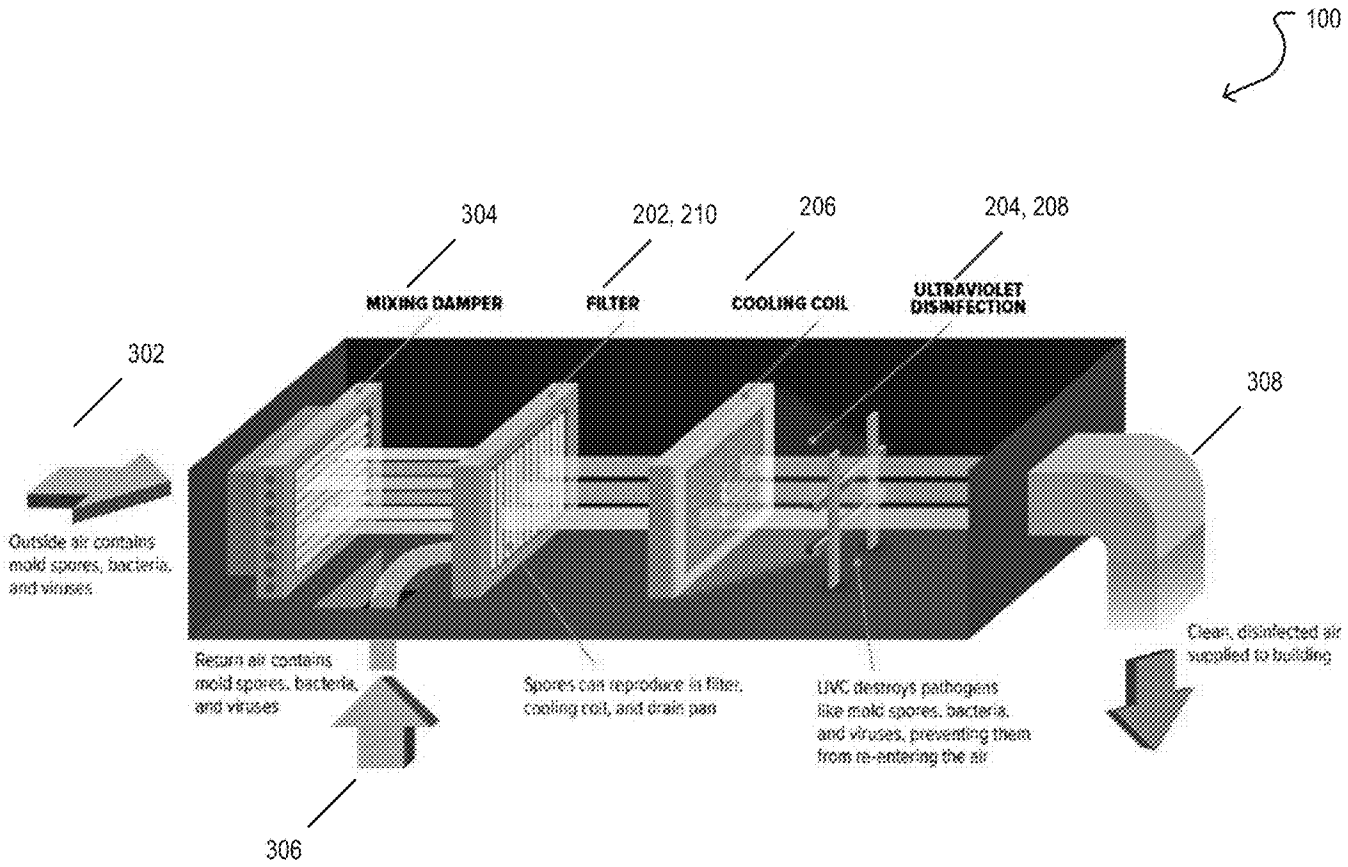
FIG. 3 is another diagram of aspects of the ultraviolet air purifying system according to an example of the instant disclosure.

FIG. 3 is another diagram of aspects of the ultraviolet air purifying system 100 according to an example of the instant disclosure. As shown in FIG. 3, the airflow 102 may include outside air 302 that may have mold spores, bacteria, and viruses, among other things. The airflow 102 including the outside air 302 may pass through a mixing damper 304. After passing through the mixing damper 304, the airflow 102 may be provided to the at least one filter 202. In addition to the outside air 302, return air 306 may also be supplied to the at least one filter 202. The return air 306 may include mold spores, bacteria, and viruses, among other things. It is possible that spores could reproduce in the at least one filter 202, heating or cooling coil 206, and drain pan of the HVAC system.

Next, the airflow 102 including the outside air 302 and the return air 306 passes through at least one cooling coil 206. After passing through the at least one heating or cooling coil 206, the ultraviolet air purifying system 100 performs ultraviolet disinfection using the at least one first UV device or lamp 204 and/or the at least one second UV device or lamp 208. The airflow 102 including the outside air 302 and the return air 306 passes through the at least one first UV device 204 or lamp and/or the at least one second UV device or lamp 208. As an example, each of the at least one first UV device 204 and the at least one second UV device 208 may be an induction 300 watt UV light.

The at least one first UV device 204 and the at least one second UV device 208 destroys pathogens such as mold spores, bacteria, and viruses thereby preventing them from being in the airflow 102. Clean, disinfected air 308 is supplied to the building via the fan 212. As an example, the ultraviolet air purifying system 100 may utilize one or more equations, algorithms, and methods discussed herein to provide the clean disinfected air 308.

The at least one first UV device 204 and the at least one second UV device 208 can be operated based on an equation associated with dimensions of duct and exposure time comprising $E_t$=Vol/Q=WHL/Q, wherein Vol is equal to volume of a UV chamber in $m_3$, Q is equal to airflow in $m^3/s$, W is equal to width in meters, H is equal to height in meters, and L is equal to length in meters.

According to some examples, the at least one first UV device 204 and the at least one second UV device 208 may be operated based on an equation associated with UVGI removal rate comprising $RR=1-e^{-klmEt}$, wherein RR is equal to removal rate, k is a UV rate constant in $m^2/J$, tm is mean irradiance, and $E_t$ is exposure time in seconds. The UV rate constant may be 0.377 to eliminate coronaviruses among other types of viruses and bacteria.

Figure 4:
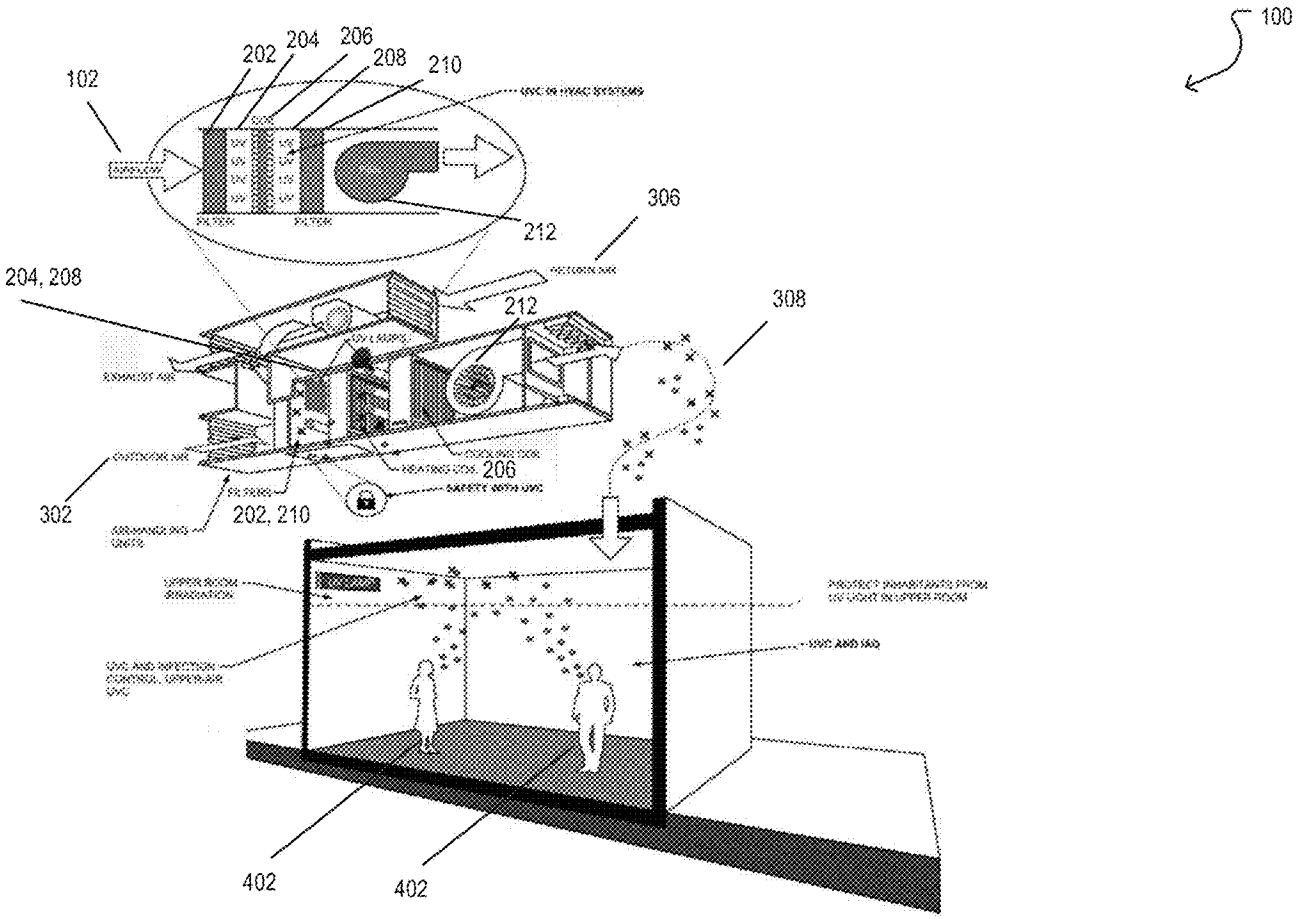
FIG. 4 is a cross-sectional view of the ultraviolet air purifying system in a building according to an example of the instant disclosure.

FIG. 4 is a cross-sectional view of the ultraviolet air purifying system 100 according to an example of the instant disclosure. As shown in FIG. 4, the ultraviolet air purifying system 100 includes the at least one first filter 202, at least one first UV device 204, at least one coil 206, at least one second UV device 208, and at least one second filter 210 as well as the at least one fan 212. The ultraviolet air purifying system 100 purifies both exhaust air or the return air 306 from the building as well as outdoor air 302. In one example, the ultraviolet air purifying system 100 may be located in an upper room section of a room of a building. This protects inhabitants 402 from UV light in the upper room section of the room of the building.

Figure 5:
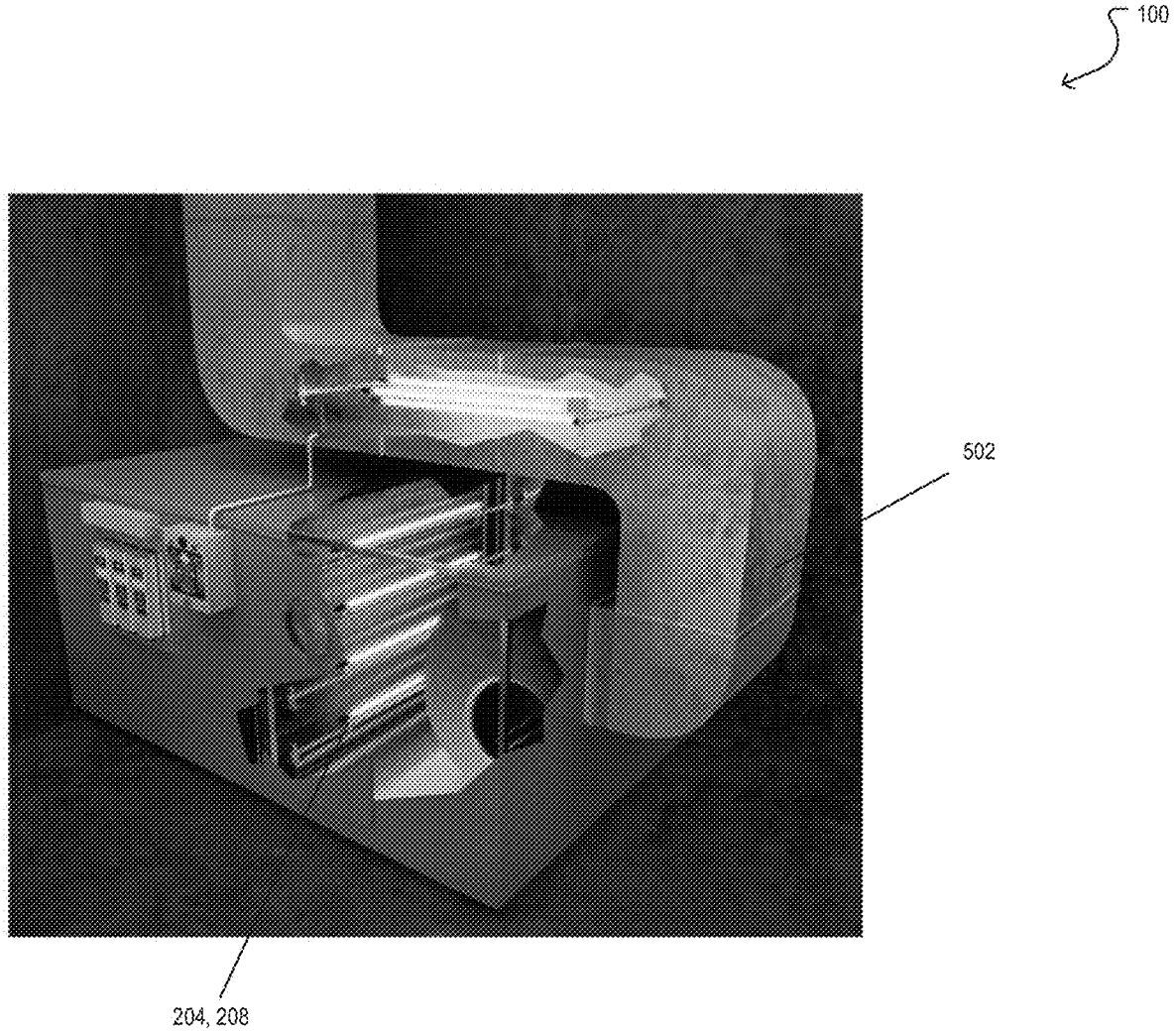
FIG. 5 is another view of the ultraviolet air purifying system associated with a heating, ventilation, and air conditioning (HVAC) system according to an example of the instant disclosure.

FIG. 5 is another view of the ultraviolet air purifying system 100 associated with an HVAC system 502 according to an example of the instant disclosure. FIG. 5 shows an exterior of the HVAC system 502 of a building as well as the interior of the HVAC system 502 of the building including the ultraviolet air purifying system 100 having the at least one first UV device 204 and/or the at least one second UV device 208. Additionally, the at least one first computing device 114 is shown as located on an exterior of the HVAC system of the building.

Figure 6:
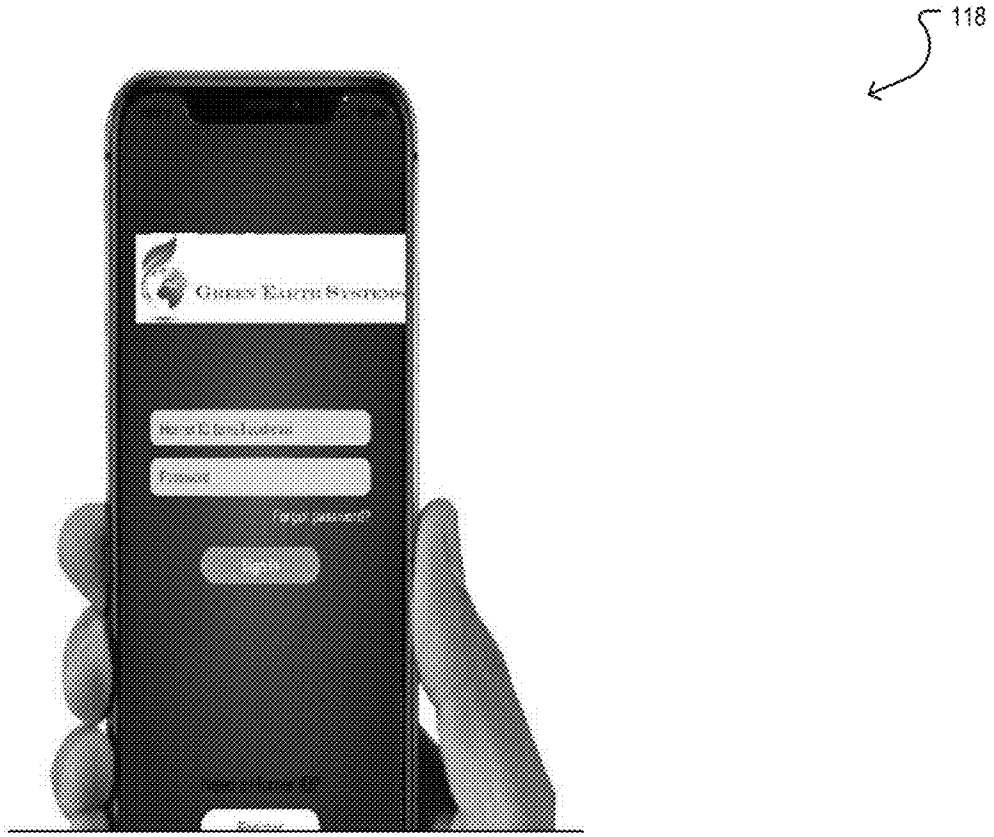
FIG. 6 is a screenshot of a realtime air analysis application executed by a computing device according to an example of the instant disclosure.

FIG. 6 is a screenshot of the realtime air analysis application 116 executed by a computing device such as the first computing device 114 and/or the second computing device 118 according to an example of the instant disclosure. As shown in FIG. 6, a user of the at least one second computing device 118 may provide username information and password information. The at least one second computing device 118 may send a request to the at least one first computing device 114 that may include a representation of the username and password. If the username and password are valid, the user of the at least one second computing device 118 may be granted access to view information and data associated with the ultraviolet air purifying system 100 such as the plurality of sensors 105 and also may provide input to control the ultraviolet air purifying system 100 for the building.

In one example, the first computing device 114, the second computing device 118, and the HVAC system may communicate using BACnet as well as other protocols. BACnet is a communication protocol for building automation and control (BAC) that works with HVAC systems to allow computing devices such as the first computing device 114 and the second computing device 118 to communicate, send requests, and exchange information with HVAC systems.

Additionally, the at least one first computing device 114 may send data, information, and alerts to the second computing device 118. The data, information, and alerts may be associated with the at least one sensor 105 such as when values of data are outside of a particular threshold for each value.

As an example, on system 100 startup, one or more UV-C lights may power on and run until an access door is opened, the UV level is below a UV disable setpoint that is adjustable, or when the air flow is below a setpoint that is adjustable.

As an example, there may be a number of alarms that can be checked in sequence and may be triggered when the values of data are outside of the particular threshold. For example, the temperature may be out of range when the temperature goes above or below one or more temperature alarm setpoints that are adjustable. The humidity may be out of range when the humidity goes above or below one or more humidity alarm setpoints that are adjustable. The $CO_2$ may be out of range when the $CO_2$ levels go above a $CO_2$ level high setpoint that is adjustable.

The UV level may be low when the UV light level is lower than a UV level low setpoint that is adjustable to indicate and notify that one or more UV lights are to be replaced or changed. A UV light disable alarm may be triggered when the UV light level is below the UV light disable setpoint that is adjustable. This may shut off the UV light.

An air flow alarm may occur when the air flow is below an air flow low setpoint that is adjustable. This may shut off the UV light. A UV light alarm reset may occur after the UV light is shut off by an alarm. In this case, it is to be reset using a reset button that may be displayed by the second computing device 118 or another computing device.

Each threshold is measured based on parameters such as:

Temperature F. or C.
Humidity % rh
CO2 parts per million (ppm)
UV-C in NM nanometer UV-C Light Wavelength and Joules (or mJ) per cm2
Airflow feet per minute (FPM)/cubic feet per minute (CFM)
Safety Open and Closed Off and ON Respectively
Ambient Pressure The SI unit of pressure is the pascal (Pa), e.g., a very small unit relative to atmospheric pressure on Earth, so kilopascals (kPa) are more commonly used in this context.
Current Like voltage, current can be AC or DC. Because the unit for current is ampères, or amps, the symbol for it is A. "A" with a wavy line over it = AC current.

Figure 7:
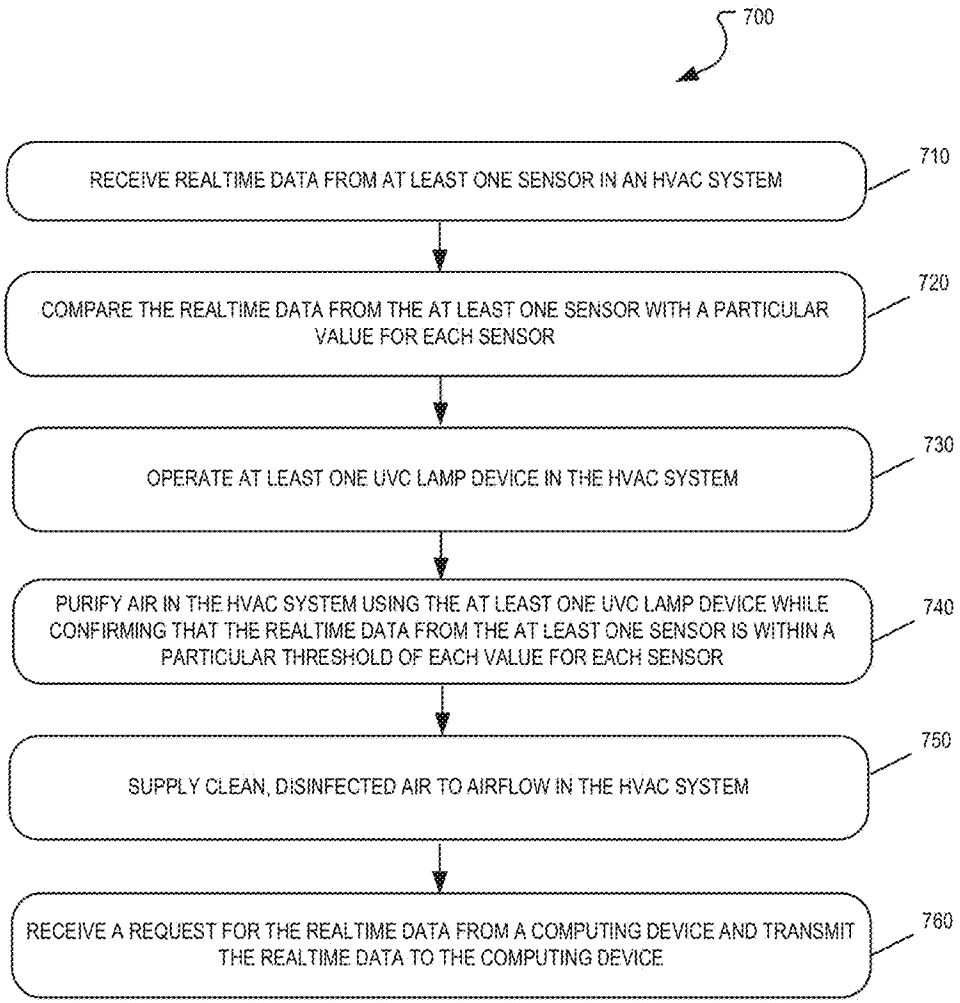
FIG. 7 is a flowchart of a method for supplying clean, disinfected air to an airflow in an HVAC system by the ultraviolet air purifying system according to an example of the instant disclosure.

FIG. 7 illustrates an example method 700 for executing one or more functions provided by the realtime air analysis application 116. Although the example method 700 depicts a particular sequence of operations, the sequence may be altered without departing from the scope of the present disclosure. For example, some of the operations depicted may be performed in parallel or in a different sequence that does not materially affect the function of the method 700. In other examples, different components of an example device or system that implements the method 700 may perform functions at substantially the same time or in a specific sequence.

According to some examples, the method 700 includes receiving realtime data from at least one sensor 105 in an HVAC system at block 710. As noted herein, the plurality of sensors 105 may include an anemometer 103, a $CO_2$ sensor device 106, a UV-C sensor device 104, a temperature sensor device 108, a humidity sensor device 110, and a pressure sensor device 111, among others.

According to some examples, the method 700 includes comparing the realtime data from the at least one sensor 105 with a particular value for each sensor at block 720. As an example, the at least one first UV-C lamp device 204 and the at least one second UV-C lamp device 208 are expected to provide light intensity around 254 nm. Disinfection may use wavelengths in the UV-C range of 240 to 280 nm. However, 254 nm is believed to be most effective. The at least one first computing device 114 may compare the realtime data from each of the at least one sensor 105.

According to some examples, the method 700 includes operating at least one UV-C lamp device of the HVAC system at block 730 such as the at least one first UV-C lamp device 204 and the at least one second UV-C lamp device 208.

According to some examples, the method 700 includes purifying air in the HVAC system using the at least one UV-C lamp device including the at least one first UV-C lamp device 204 and the at least one second UV-C lamp device 208 while confirming that the realtime data from the at least one sensor is within a particular threshold of each value for each sensor at block 740. As an example, if there is no airflow, the system 100 may be shut down. As another example, if one of the UV-C lamp devices has light intensity drop below 80% of maximum intensity, an alert or alarm may be sent to the at least one first computing device 114 and/or the at least one second computing device 118 indicating that it should be replaced or serviced. If one of the UV-C lamp devices has light intensity drop below 50% of maximum intensity, the system 100 may be shut down.

According to some examples, the method 700 includes supplying clean, disinfected air 308 to the airflow 102 in the HVAC system at block 750.

According to some examples, the method 700 includes receiving a request for realtime information from the second client computing device 118 and transmitting the realtime information to the second client computing device 118. As an example, the realtime information may be sent as an alert if there is realtime data that cannot be confirmed to be within a particular threshold of a value for at least one sensor 105. The alert may be generated and sent by the first computing device 114. The alert may be a push notification, an email, a phone call, or another type of alert.

According to some examples, the method 700 may include transmitting the realtime data to be displayed in a graphical user interface (GUI) on a display of the at least one second computing device 118.

According to some examples, the method 700 may include receiving a request to control at least one component in the HVAC system such as heating or cooling systems from the at least one second computing device 118 or the at least one first computing device 114.

According to some examples, the method 700 may include transmitting the realtime data to the at least one first computing device 114 or the at least one second computing device 118 device using the BACnet protocol, e.g., a communication protocol for Building Automation and Control (BAC) networks using the ASHRAE, ANSI, ISO 16484-5 standard protocol.

According to some examples, the at least one UV-C lamp device 204, 208 is operated based on an equation associated with dimensions of duct and exposure time comprising $E_t$=Vol/Q=WHL/Q, wherein Vol is equal to volume of a UV chamber in $m^3$, Q is equal to airflow in $m^3/s$, W is equal to width in meters, H is equal to height in meters, and L is equal to length in meters.

According to some examples, the at least one UV-C lamp device 204, 208 is operated based on an equation associated with UVGI removal rate comprising $RR=1-e^{-kImEt}$, wherein RR is equal to removal rate that is a fraction or percentage, k is a UV rate constant in $m^2/J$, $I_m$ is mean irradiance, $W/m^2$, and $E_t$ is exposure time in seconds. The UV rate constant may be 0.377 to eliminate pathogens including coronaviruses among other types of viruses and bacteria.

Figure 8:
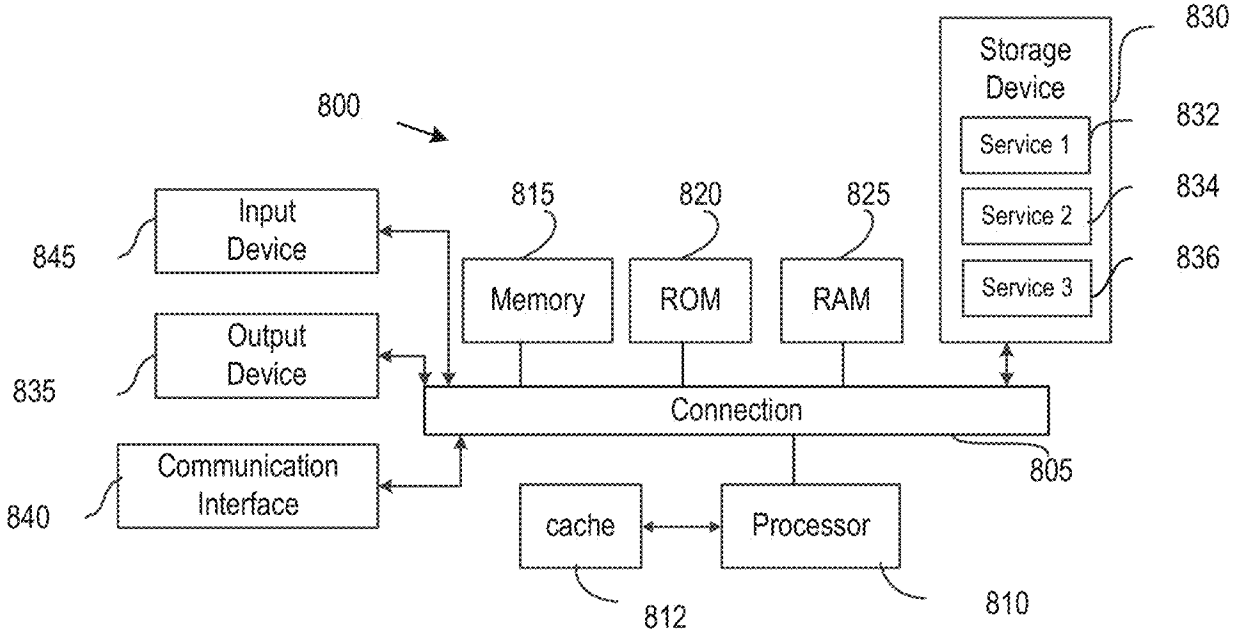
FIG. 8 shows an example of a system for implementing certain aspects of the present technology.

FIG. 8 shows an example of computing system 800, which can be for example any computing device making up the at least one first computing device 114, the at least one second computing device 118, or any component thereof in which the components of the system are in communication with each other using connection 805. Connection 805 can be a physical connection via a bus, or a direct connection into processor 810, such as in a chipset architecture. Connection 805 can also be a virtual connection, networked connection, or logical connection.

In some embodiments, computing system 800 is a distributed system in which the functions described in this disclosure can be distributed within a datacenter, multiple data centers, a peer network, etc. In some embodiments, one or more of the described system components represents many such components each performing some or all of the function for which the component is described. In some embodiments, the components can be physical or virtual devices.

Example system 800 includes at least one processing unit (CPU or processor) 810 and connection 805 that couples various system components including system memory 815, such as read-only memory (ROM) 820 and random access memory (RAM) 825 to processor 810. Computing system 800 can include a cache of high-speed memory 812 connected directly with, in close proximity to, or integrated as part of processor 810.

Processor 810 can include any general purpose processor and a hardware service or software service, such as services 832, 834, and 836 stored in storage device 830, configured to control processor 810 as well as a special-purpose processor where software instructions are incorporated into the actual processor design. Processor 810 may essentially be a completely self-contained computing system, containing multiple cores or processors, a bus, memory controller, cache, etc. A multi-core processor may be symmetric or asymmetric.

To enable user interaction, computing system 800 includes an input device 845, which can represent any number of input mechanisms, such as a microphone for speech, a touch-sensitive screen for gesture or graphical input, keyboard, mouse, motion input, speech, etc. Computing system 800 can also include output device 835, which can be one or more of a number of output mechanisms known to those of skill in the art. In some instances, multimodal systems can enable a user to provide multiple types of input/output to communicate with computing system 800. Computing system 800 can include communications interface 840, which can generally govern and manage the user input and system output. There is no restriction on operating on any particular hardware arrangement, and therefore the basic features here may easily be substituted for improved hardware or firmware arrangements as they are developed.

Storage device 830 can be a non-volatile memory device and can be a hard disk or other types of computer readable media which can store data that are accessible by a computer, such as magnetic cassettes, flash memory cards, solid state memory devices, digital versatile disks, cartridges, random access memories (RAMs), read-only memory (ROM), and/or some combination of these devices.

The storage device 830 can include software services, servers, services, etc., that when the code that defines such software is executed by the processor 810, it causes the system to perform a function. In some embodiments, a hardware service that performs a particular function can include the software component stored in a computer-readable medium in connection with the necessary hardware components, such as processor 810, connection 805, output device 835, etc., to carry out the function.

For clarity of explanation, in some instances, the present technology may be presented as including individual functional blocks including functional blocks comprising devices, device components, steps or routines in a method embodied in software, or combinations of hardware and software.

Any of the steps, operations, functions, or processes described herein may be performed or implemented by a combination of hardware and software services or services, alone or in combination with other devices. In some embodiments, a service can be software that resides in memory of a client device and/or one or more servers of a content management system and perform one or more functions when a processor executes the software associated with the service. In some embodiments, a service is a program or a collection of programs that carry out a specific function. In some embodiments, a service can be considered a server. The memory can be a non-transitory computer-readable medium.

In some embodiments, the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer-readable media. Such instructions can comprise, for example, instructions and data which cause or otherwise configure a general purpose computer, special purpose computer, or special purpose processing device to perform a certain function or group of functions. Portions of computer resources used can be accessible over a network. The executable computer instructions may be, for example, binaries, intermediate format instructions such as assembly language, firmware, or source code. Examples of computer-readable media that may be used to store instructions, information used, and/or information created during methods according to described examples include magnetic or optical disks, solid-state memory devices, flash memory, USB devices provided with non-volatile memory, networked storage devices, and so on.

Devices implementing methods according to these disclosures can comprise hardware, firmware and/or software, and can take any of a variety of form factors. Typical examples of such form factors include servers, laptops, smartphones, small form factor personal computers, personal digital assistants, and so on. The functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are means for providing the functions described in these disclosures.

Illustrative examples of the disclosure include:

Aspect 1: A method comprising: receiving, by at least one processor, realtime data associated with airflow in a heating, ventilation, and air conditioning (HVAC) system from at least one sensor device, comparing, by the at least one processor, the realtime data from the at least one sensor device with a particular value for each sensor, operating, by the at least one processor, at least one ultraviolet C (UV-C)

lamp device in the HVAC system, purifying air in the HVAC system using the at least one UV-C lamp device while confirming, by the at least one processor, that the realtime data from the at least one sensor device is within a particular threshold of each particular value for each sensor, and supplying clean, disinfected air to the airflow in the HVAC system.

Aspect 2: The method of Aspect 1, wherein the at least one sensor device comprises an anemometer, a $CO_2$ sensor device, a UV-C sensor device, a temperature sensor device, a humidity sensor device, and a pressure sensor device.

Aspect 3: The method of Aspects 1 and 2, further comprising receiving a request for the realtime data from a computing device and transmitting the realtime data to the computing device.

Aspect 4: The method of any of Aspects 1 to 3, further comprising transmitting the realtime data to be displayed in a graphical user interface (GUI) on a display of the computing device.

Aspect 5: The method of any of Aspects 1 to 4, further comprising receiving, by the at least one processor, a request to control at least one component in the HVAC system from a computing device.

Aspect 6: The method of any of Aspects 1 to 5, further comprising transmitting the realtime data to a computing device using the BACnet protocol.

Aspect 7: The method of any of Aspects 1 to 6, wherein at least one UV-C lamp device is operated based on an equation associated with dimensions of duct and exposure time comprising $E_t$=Vol/Q=WHL/Q, wherein Vol is equal to volume of a UV chamber in $m^3$, Q is equal to airflow in $m^3/s$, W is equal to width in meters, H is equal to height in meters, and L is equal to length in meters.

Aspect 8: The method of any of Aspects 1 to 7, wherein at least one UV-C lamp device is operated based on an equation associated with UVGI removal rate comprising $RR=1-e^{-klmEt}$, wherein RR is equal to removal rate, k is a UV rate constant in $m^2/J$, $I_m$ is mean irradiance, and $E_t$ is exposure time in seconds.

Aspect 9: The method of any of Aspects 1 to 8, wherein the UV rate constant comprises 0.377.

Aspect 10: A system including at least one sensor device and at least one processor to receive realtime data associated with airflow in a heating, ventilation, and air conditioning (HVAC) system from the at least one sensor device, compare the realtime data from the at least one sensor device with a particular value for each sensor, operate at least one ultraviolet C (UV-C) lamp device in the HVAC system, purify air in the HVAC system using the at least one UV-C lamp device while confirming that the realtime data from the at least one sensor device is within a particular threshold of each particular value for each sensor, and supply clean, disinfected air to the airflow in the HVAC system.

Aspect 11: The system of Aspect 10, wherein the at least one sensor device comprises an anemometer, a $CO_2$ sensor device, a UV-C sensor device, a temperature sensor device, a humidity sensor device, and a pressure sensor device Aspect 12: The system of Aspects 10 and 11, the at least one processor further to receive a request for the realtime data from a computing device and transmit the realtime data to the computing device.

Aspect 13: The system of Aspects 10 to 12, the at least one processor further to transmit the realtime data to be displayed in a graphical user interface (GUI) on a display of the computing device.

Aspect 14: The system of Aspects 10 to 13, the at least one processor further to receive a request to control at least one component in the HVAC system from a computing device.

Aspect 15: The system of Aspects 10 to 14, the at least one processor further to transmit the realtime data to a computing device using the BACnet protocol.

Aspect 16: The system of Aspects 10 to 15, wherein at least one UV-C lamp device is operated based on an equation associated with dimensions of duct and exposure time comprising $E_t$=Vol/Q=WHL/Q, wherein Vol is equal to volume of a UV chamber in $m^3$, Q is equal to airflow in $m^3/s$, W is equal to width in meters, H is equal to height in meters, and L is equal to length in meters.

Aspect 17: The system of Aspects 10 to 16, wherein at least one UV-C lamp device is operated based on an equation associated with UVGI removal rate comprising $RR=1-e^{-klmEt}$, wherein RR is equal to removal rate, k is a UV rate constant in $m^2/J$, $I_m$ is mean irradiance, and $E_t$ is exposure time in seconds.

Aspect 18: The system of Aspects 10 to 17, wherein the UV rate constant comprises 0.377.

Aspect 19: A non-transitory computer-readable storage medium, having instructions stored thereon that, when executed by at least one computing device cause the at least one computing device to perform operations, the operations comprising receiving realtime data associated with airflow in a heating, ventilation, and air conditioning (HVAC) system from at least one sensor device, comparing the realtime data from the at least one sensor device with a particular value for each sensor, operating at least one ultraviolet C (UV-C) lamp device in the HVAC system, purifying air in the HVAC system using the at least one UV-C lamp device while confirming that the realtime data from the at least one sensor device is within a particular threshold of each particular value for each sensor, and supplying clean, disinfected air to the airflow in the HVAC system.

Aspect 20: The non-transitory computer-readable storage medium of Aspect 19, wherein the at least one sensor device comprises an anemometer, a $CO_2$ sensor device, a UV-C sensor device, a temperature sensor device, a humidity sensor device, and a pressure sensor device.

What is claimed is:

1. A method comprising:

receiving, by at least one processor, realtime data associated with airflow in a heating, ventilation, and air conditioning (HVAC) system from at least one sensor device;

comparing, by the at least one processor, the realtime data from the at least one sensor device with a particular value for each sensor device;

operating, by the at least one processor, at least one ultraviolet C (UV-C) lamp device in the HVAC system;

purifying air in the HVAC system using the at least one UV-C lamp device while confirming, by the at least one processor, that the realtime data from the at least one sensor device is within a particular threshold of each particular value for each sensor device, wherein the at least one UV-C lamp device is operated based on an equation associated with UVGI removal rate comprising $RR=1-e^{-klmEt}$, wherein RR is equal to removal rate, k is a UV rate constant in $m^2/J$, $I_m$ is mean irradiance, and $E_t$ is exposure time in seconds; and supplying clean, disinfected air to the airflow in the HVAC system.

2. The method of claim 1, wherein the at least one sensor device comprises an anemometer, a $CO_2$ sensor device, a UV-C sensor device, a temperature sensor device, a humidity sensor device, and a pressure sensor device.

3. The method of claim 1, further comprising receiving a request for the realtime data from a computing device and transmitting the realtime data to the computing device.

4. The method of claim 3, further comprising transmitting the realtime data to be displayed in a graphical user interface (GUI) on a display of the computing device.

5. The method of claim 1, further comprising receiving, by the at least one processor, a request to control at least one component in the HVAC system from a computing device.

6. The method of claim 1, further comprising transmitting the realtime data to a computing device using the BACnet protocol.

7. The method of claim 1, wherein the at least one UV-C lamp device is operated based on an equation associated with dimensions of duct and exposure time comprising $E_t$=Vol/Q=WHL/Q, wherein Vol is equal to volume of a UV chamber in $m^3$, Q is equal to airflow in $m^3/s$, W is equal to width in meters, H is equal to height in meters, and L is equal to length in meters.

8. The method of claim 1, wherein the UV rate constant comprises 0.377.

9. A non-transitory computer-readable storage medium, having instructions stored thereon that, when executed by at least one computing device cause the at least one computing device to perform operations, the operations comprising:

receiving realtime data associated with airflow in a heating, ventilation, and air conditioning (HVAC) system from at least one sensor device;

comparing the realtime data from the at least one sensor device with a particular value for each sensor device;

operating at least one ultraviolet C (UV-C) lamp device in the HVAC system;

purifying air in the HVAC system using the at least one UV-C lamp device while confirming that the realtime data from the at least one sensor device is within a particular threshold of each particular value for each sensor device, wherein the at least one UV-C lamp device is operated based on an equation associated with UVGI removal rate comprising $RR=1-e^{-klmEt}$, wherein RR is equal to removal rate, k is a UV rate constant in $m^2/J$, $I_m$ is mean irradiance, and Et is exposure time in seconds; and supplying clean, disinfected air to the airflow in the HVAC system.

10. The non-transitory computer readable storage medium of claim 9, wherein the at least one sensor device comprises an anemometer, a $CO_2$ sensor device, a UV-C sensor device, a temperature sensor device, a humidity sensor device, and a pressure sensor device.

* * * * *